US007117955B2

(12) United States Patent
Rivers et al.

(10) Patent No.: US 7,117,955 B2
(45) Date of Patent: Oct. 10, 2006

(54) DRIVER CAP

(75) Inventors: Paul Brent Rivers, Cullman, AL (US); Frederick James Diggle, Birmingham, AL (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 0 days.

(21) Appl. No.: 10/789,786

(22) Filed: Feb. 28, 2004

(65) Prior Publication Data

US 2005/0189129 A1 Sep. 1, 2005

(51) Int. Cl.
*B21J 5/00* (2006.01)
*B23P 17/00* (2006.01)

(52) U.S. Cl. ..... 173/1; 173/171; 29/423; 52/301

(58) Field of Classification Search ..... 173/1, 173/90, 128–133, 171; 29/450, 243.5, 254, 29/255, 423, 418, 424; 175/19–22; 227/141, 227/147; 52/301, 736.1–4; 81/124.3, 492
See application file for complete search history.

(56) References Cited

U.S. PATENT DOCUMENTS

| | | | | |
|---|---|---|---|---|
| 59,990 A | | 11/1866 | Foley | |
| 735,205 A | | 8/1903 | Bunger | |
| 1,443,596 A | | 1/1923 | Schaefer | |
| RE15,699 E | | 8/1923 | Hindmarsh | |
| 1,798,753 A | | 3/1931 | Paque | |
| 2,147,829 A | * | 2/1939 | Daniels | 173/126 |
| 2,629,985 A | * | 3/1953 | McDowell | 173/91 |
| 2,690,055 A | * | 9/1954 | Lundgren et al. | 405/232 |
| 2,839,754 A | * | 6/1958 | Pfaff | 227/147 |
| 2,973,520 A | * | 3/1961 | Bell | 227/147 |
| 3,211,241 A | * | 10/1965 | Kikuchi | 173/131 |
| 4,065,045 A | * | 12/1977 | Pray | 227/147 |
| 4,315,551 A | * | 2/1982 | Iannone | 173/128 |
| 4,557,409 A | * | 12/1985 | Hecock et al. | 227/147 |
| 4,972,864 A | | 11/1990 | Almond | |
| 5,020,605 A | * | 6/1991 | Leishman | 173/1 |
| 6,578,457 B1 | * | 6/2003 | Eichhorn | 82/160 |
| 6,648,203 B1 | * | 11/2003 | Lord | 227/147 |

* cited by examiner

*Primary Examiner*—Stephen F. Gerrity
*Assistant Examiner*—Paul Durand
(74) *Attorney, Agent, or Firm*—Bambi Faivre Walters; Walters & Zimmerman

(57) ABSTRACT

The driver cap assembly of this invention includes a tubular body and a driver sleeve that may be positioned over and/or about an end of a shafted body. A force is applied to the driver cap such that the other end of the shafted body is driven into a surface. The driver cap facilitates a variety of shaft sizes and shapes. Alternate embodiments of this invention disclose a driver cap assembly that includes a tubular body and an H-shaped sleeve.

3 Claims, 4 Drawing Sheets

DRIVER CAP

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but otherwise reserves all copyrights whatsoever.

BACKGROUND OF THE INVENTION

1. Field of the Invention

This invention relates generally to the field of hardware and equipment. More particularly, this invention relates to a driver cap for driving shafted bodies into a surface, such as the earth.

2. Description of Related Art

Shafted bodies, such as rods and/or bolts, are driven into a surface, such as the earth and/or a wall. For example, telecommunications technicians drive grounding rods into the earth for new installations of telecommunications services and equipment. These rods are made of a good-conducting material, such as, for example, steel or copper, and these rods have a length of at least three feet to about eight feet. Depending on soil conditions, these rods can be difficult to drive into the ground. And, when extremely forceful impacts are used to drive the rod to the desired depth, the grounding rod can deform. Such impacts may distort the top of the grounding rod into a mushroom shape. This frayed or splayed end tip makes it difficult to install a ground clamp over the top of the rod. And, excessive impacts into the hard soil may bend the top of the rod, thus making it necessary to start a new rod or to try to hammer out (i.e., unbend) the bended portion of the rod. Still another problem with driving the rod into the ground is that the small impact area of the top of the rod can be difficult to hit, especially if the rod is twanging back and forth from the impact of a hammer.

Another example is driving a hammer bolt, also referred to as a "hardhat," into a telecommunications pole. To drive the hardhat into the telecommunications pole, the technician must forcefully hammer the hardhat. Sometimes the hardhat "bounces" away and falls to the ground below. Other times, when the hardhat is driven into the pole at an angle, the hardhat fractures the surface of the pole, thus making it necessary to start a new hardhat.

Accordingly, there is a need for a driver device that facilitates driving a shafted body into a surface. Additionally, there is a need for the driver device to accommodate a variety of shaft sizes and shapes.

SUMMARY OF THE INVENTION

This invention addresses the above needs and others by providing a driver cap assembly that may be positioned over and/or about an end of a shafted body. A force is applied to the driver cap such that the other end of the shafted body is driven into a surface. The driver cap facilitates a variety of shaft sizes and shapes. Moreover, the driver cap prevents fraying and/or splaying of the top of the shaft when it's subjected to a forceful impact. The driver cap assembly may be made of a variety of materials, such as, for example, metal, polymer, plastic, paper, cloth, ceramic, glass, and/or crystal.

In an embodiment, a driver cap assembly includes a tubular body and a driver sleeve. The tubular body has a closed proximal end, an elongated shank, and an open distal end. A first portion of the closed proximal end flares outward from a proximal end of the elongated shank towards a second portion of the closed proximal end and provides both a larger surface area for applying the force and added mass to minimize twanging. An interior section of the elongated shank and the open distal end comprise a longitudinal bore that is shaped to mate with an exterior complimentary section of the driver sleeve. The interior of the driver sleeve includes a second longitudinal bore that is shaped to fit about a shafted body, such as a grounding rod or a hardhat. According to further embodiments, the interior of the longitudinal bore and/or the second longitudinal bore may be threaded such that the tubular body could be screwed onto and/or off of the sleeve or the sleeve could be screwed onto and/or off of the shafted body.

In another embodiment, a driver cap assembly may include a tubular body and an H-shaped sleeve. Similar to the embodiments above, the tubular body includes a closed proximal end, an elongated shank, and an open distal end. A first portion of the closed proximal end flares outward from a proximal end of the elongated shank towards a second portion of the closed proximal end and provides both a larger surface area for applying the force and added mass to minimize twanging. An interior section of the elongated shank and the open distal end comprise a longitudinal bore that is shaped to mate with an exterior complimentary section of the H-shaped sleeve. The H-shaped sleeve includes a first interior, longitudinal bore and a second interior, longitudinal bore. The first interior, longitudinal bore of the H-shaped sleeve is adapted to fit about a proximal end of a shafted body having a first measurement, and the second interior, longitudinal bore of the H-shaped sleeve is adapted to fit about another proximal end of a shafted body having a second measurement. For example, the first interior, longitudinal bore may have a diameter that is approximately half of an inch and the second interior, longitudinal bore may have a diameter that is approximately five-eighths of an inch.

Further details on these embodiments and other possible embodiments including methods for using the driver cap assembly are set forth below. As is appreciated by those of ordinary skill in the art, this invention has wide utility in a number of areas as illustrated by the discussion below. These embodiments may be accomplished singularly, or in combination, in one or more of the implementations of this invention.

BRIEF DESCRIPTION OF THE DRAWINGS

The above and other embodiments, objects, uses, advantages, and novel features of this invention are more clearly understood by reference to the following description taken in connection with the accompanying figures, wherein.

DETAILED DESCRIPTION OF THE INVENTION

This invention now will be described more fully hereinafter with reference to the accompanying drawings, in which exemplary embodiments are shown. This invention may, however, be embodied in many different forms and should not be construed as limited to the embodiments set forth herein; rather these embodiments are provided so that this disclosure will be thorough and complete, and will fully convey the scope of invention to those of ordinary skill in the art. Like numbers refer to like elements throughout. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure). Thus, for example, it will be appreciated by those of ordinary skill in the art that the schematics and the like represent conceptual views of illustrative structures embodying this invention.

In the claims hereof any element expressed as a means for performing a specified function is intended to encompass any way of performing that function including, for example, a combination of elements that performs that function. The invention as defined by such claims resides in the fact that the functionalities provided by the various recited means are combined and brought together in the manner that the claims call for. Applicants thus regard any means that can provide those functionalities as equivalents as those shown herein.

The driver cap assembly of this invention may be positioned over and/or about an end of a shafted body having a variety of shapes and sizes. A force is applied to the positioned driver cap such that the other end of the shafted body is driven into a surface. As discussed further below, using the driver cap to drive the shafted body into the surface prevents and/or minimizes fraying and/or splaying of the top of the shaft when it's subjected to the forceful impact. That is, without using the driver cap, the top of the shaft tends to flatten upon being repeatedly subjected to forces to drive the shafted body into a surface, and it tends to develop a flanged or mushroomed rim. Additionally, using the driver cap assembly of this invention provides a larger and/or may provide a brightly colored target for applying the force and driving the shafted body into the surface. Still further advantages of using the driver cap are discussed throughout this section.

Figure 3:
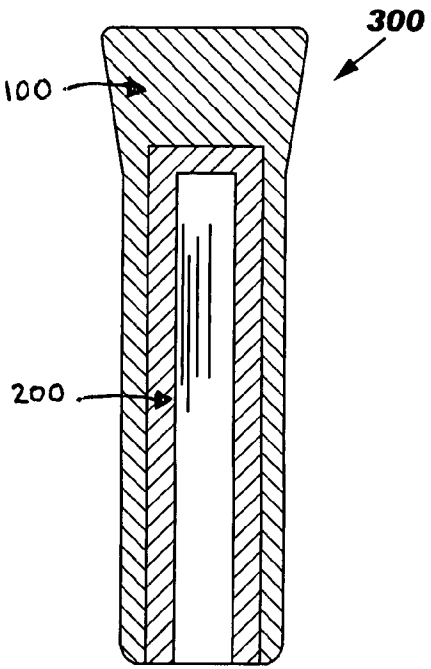
FIG. 3 is a perspective, cut away side view of the driven cap of FIG. 1A assembled with the inner sleeve of FIG. 2B according to embodiments of this invention.
Figure 2B:
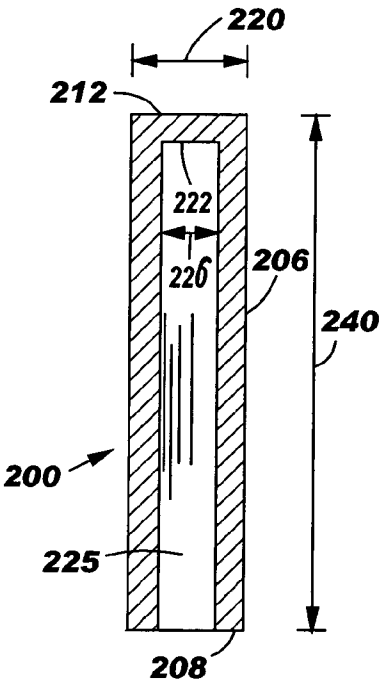
FIG. 2B is a perspective top view of the inner sleeve of FIG. 2A.
Figure 2A:
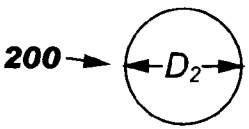
FIG. 2A is a perspective side view of an inner sleeve of the driven cap of FIG. 1.

Referring now to FIGS. 1A–4, a driver cap assembly 300 is shown according to embodiments of this invention. The driver cap assembly 300 includes a tubular body 100 and a driver sleeve 200. The tubular body 100 includes a closed proximal end 102, an elongated shank 106, and an open distal end 108. A first portion 104 of the closed proximal end 102 flares outward towards a second portion 105 of the closed proximal end 102 for a height 145, and this flared configuration is referred to herein as the "head" of the driver cap assembly 300. A longitudinal bore 115 of an interior 110, 112, 114 of the elongated shank 106 and the open distal end 108 is configured to mate with an exterior surface 206, 212 of the driver sleeve 200. For example, the longitudinal bore 115 has an inner diameter 116 slightly greater than an external diameter 220 of the driver sleeve 200 to provide an aligned accommodation when the two components 100, 200 are mated and an external length 240 of the driver sleeve 200 is equal to or greater than an internal length of the elongated shank 106. The driver sleeve includes a closed proximal end 212, an elongated shank 206, and an open distal end 208 having a second longitudinal bore 225 that is configured to mate with an end of a shafted body (shown as grounding rod 410 in FIG. 4). FIG. 3 shows the driver cap assembly 300 with the tubular body 100 assembled with the driver sleeve 200. The driver cap assembly 300 may be composed of a variety of materials, such as metal, paper, cloth, polymer, plastic, ceramic, glass, and/or crystal. According to embodiments of this invention, the tubular body 100 is composed of steel, iron, and/or any other metal alloy having a Rockwell hardness of at least 49. According to other embodiments of this invention, the driver sleeve 200 may be made of the same material as the tubular body 100 or a different material, such as, for example a high durometer rubber and/or a softer metal.

Figure 4:
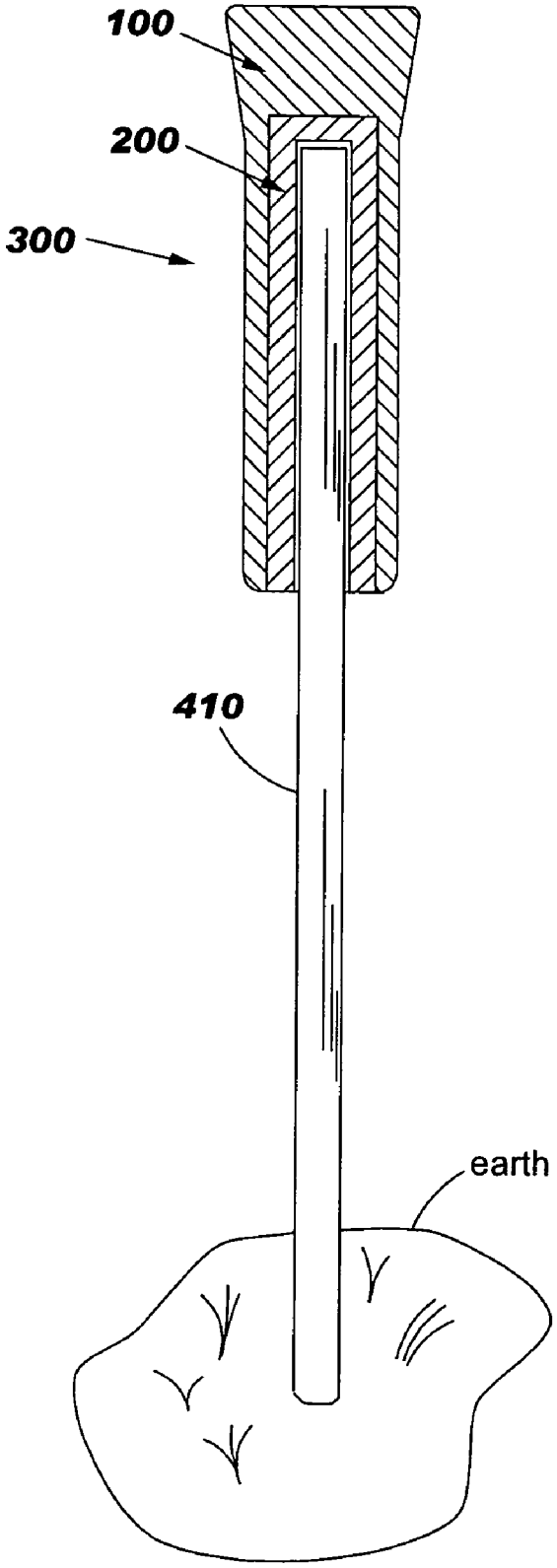
FIG. 4 is a perspective, cut away side view of the assembled driven cap of FIG. 1A and the inner sleeve of FIG. 2A positioned on a ground rod according to embodiments of this invention.

As shown in FIG. 4, the driver cap assembly 300 is positioned over an upper end of a grounding rod 410. A force is applied to the head of the driver cap assembly 300 and the lower end of the grounding rod 410 is driven into the earth. After the grounding rod 410 is driven to a desired depth, the driver cap assembly 300 is removed and a ground clamp (not shown) may be installed over the upper end of the grounding rod 410. The head of the driver cap assembly 300 has an exterior diameter 120 greater than a diameter 130 of the elongated shank 106, and an increased surface area of the exterior diameter 120 provides a larger target for applying a force to drive the shafted body, such as the grounding rod 410 of FIG. 4. According to embodiments of this invention, the closed proximal end 102 may be made of, painted, and/or otherwise colored of a brightly colored material. The bright color provides easy visual detection for aiming, aligning, and/or applying the force to the closed proximal end 102. Still further, the head of the driver cap assembly 300 increases mass to the upper end of the grounding rod 410 to reduce twanging back and forth from the force of the impacts and, thereby, improves aligning the impact with the driver cap assembly 300 and/or reduces bending of the upper end of the grounding rod 410. For example, if the driver cap assembly 300 is not used, then the grounding rod 410 tends to twang back and forth with repeated impacts. Because the grounding rod moves back and forth, the force can easily be misaligned such that the resultant misaligned and applied force bends the upper end. Oftentimes if the upper end of a grounding rod is bent, then the damaged grounding rod is removed and replaced with an undamaged grounding rod.

The driver sleeve 200 has the general shape of a cylinder and an internal diameter 226 that is sized to accept the grounding rod 410. As those of ordinary skill in the art appreciate, the diameter 226 may be sized to accommodate one of a variety of grounding rod diameters, such as grounding rods with a diameter of about ¼ inch and greater (e.g., ½ inch, 9/16 inch, ⅝ inch, ¾ inch, 1 inch, 2 inches,and so on). Because the driver sleeve 200 is easily removable from the tubular body 100, a user could remove a driver sleeve (not shown) having a diameter (not shown) that is not sized for the grounding rod 410 (i.e., the diameter of the removed driver sleeve is too small or too large for the grounding rod) from the tubular body and select another driver sleeve 200 with having a diameter 226 that is sized to accommodate the diameter of the grounding rod 410 and mate it with the tubular body 100. Thus, the tubular body 100 mates with a variety of driver sleeves each having a different sized diameter.

The tubular body 200 has a generally cylindrical shape with the head symmetrically flaring out from the elongated shank 106 to the closed proximal end 102. The external diameter 120 of the closed proximal head is at least 1¼ times that of a diameter 108 of the elongated shank 106. The length 140 of the tubular body 200 is from about 2 to 10 times the external diameter 120. According to embodiments of this invention, the tubular body 100 and the driver sleeve 200 are both concentric, and the driver sleeve 200 slides into the second longitudinal bore 225. According to alternate embodiments, the driver cap assembly 300 may take on a variety of other shapes, such as polygonal and non-polygonal, to accommodate a shafted body that does not have a concentric cross-section. Thus, the driver cap assembly 300 may be positioned over a variety of shafted bodies having alternate cross-sections, such as, for example, rectangular, hexagonal, and so on.

Figure 1A:
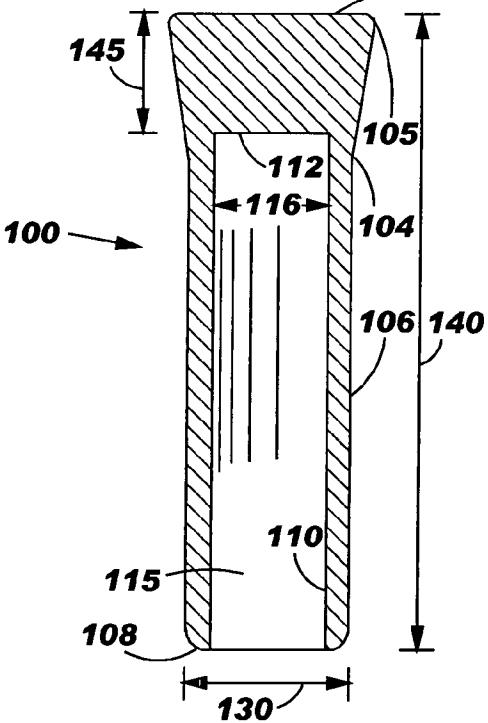
FIG. 1A is a perspective side view of a driven cap according to embodiments of this invention.
Figure 1B:
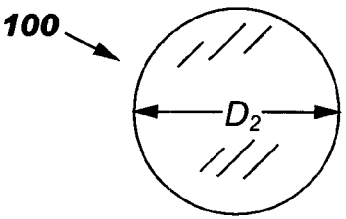
FIG. 1B is a perspective top view of the driven cap of FIG. 1.
Figure 5:
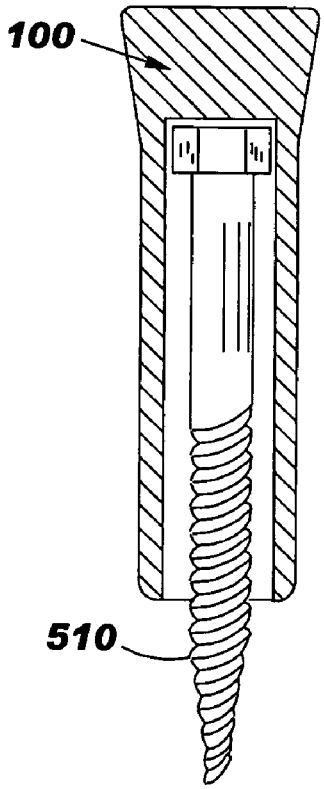
FIG. 5 is a perspective, cut away side view of the driven cap of FIG. 1A positioned on a bolt according to embodiments of this invention.

Referring now to FIG. 5, a cross section of a perspective side view of the tubular body 100 of FIG. 1 is shown positioned over and/or about a hardhat. The hardhat resembles a conventional lag bolt. The hardhat is initially driven, and then further threaded, into the telecommunications pole 410. Hardhats have an approximate diameter of ¾ inch and require forceful hammering to initially drive the hardhat into the surface of the telecommunications pole. The tubular body 100 may be used to stabilize the hardhat during the initial hammering to prevent the hardhat from bouncing away and/or to guide the hardhat into the surface.

Figure 7:
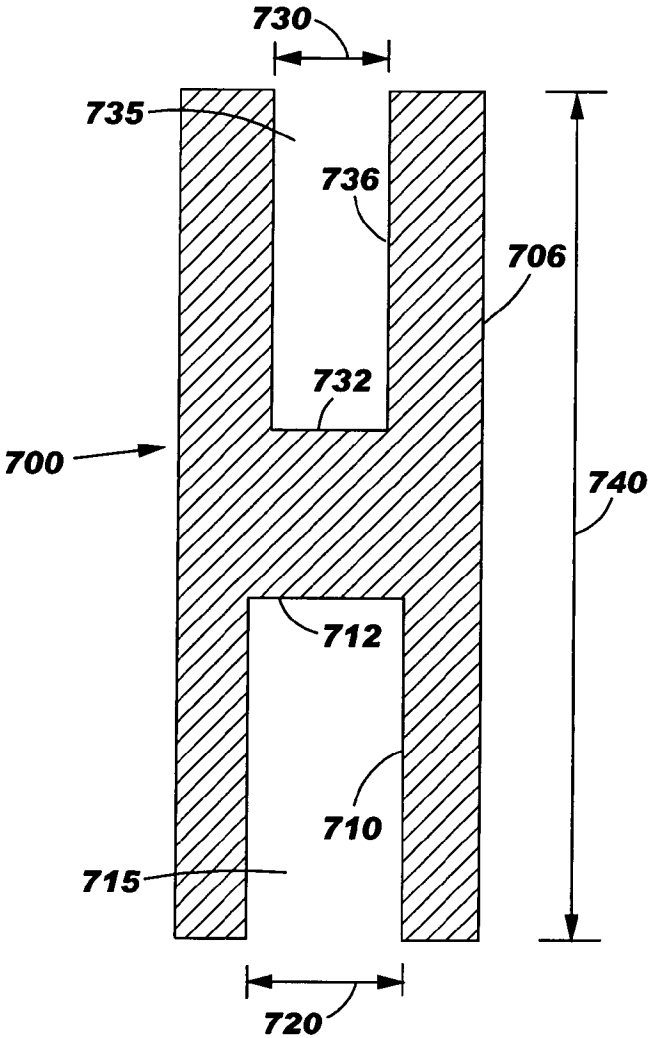
FIG. 7 is a perspective, cut away side view of the alternate inner sleeve of FIG. 6.
Figure 6:
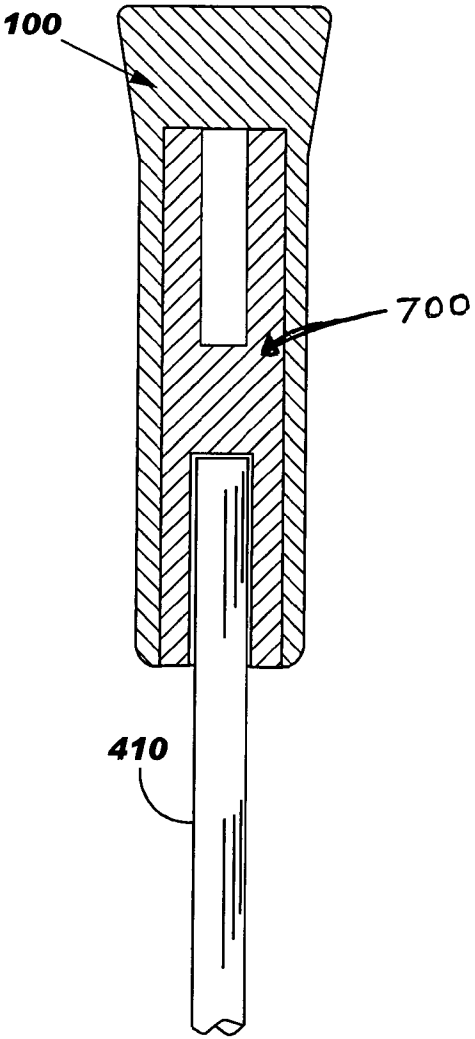
FIG. 6 is a perspective, cut away side view of the driven cap of FIG. 1A assembled with an alternate inner sleeve and positioned on a ground rod according to embodiments of this invention.
Figure 8:
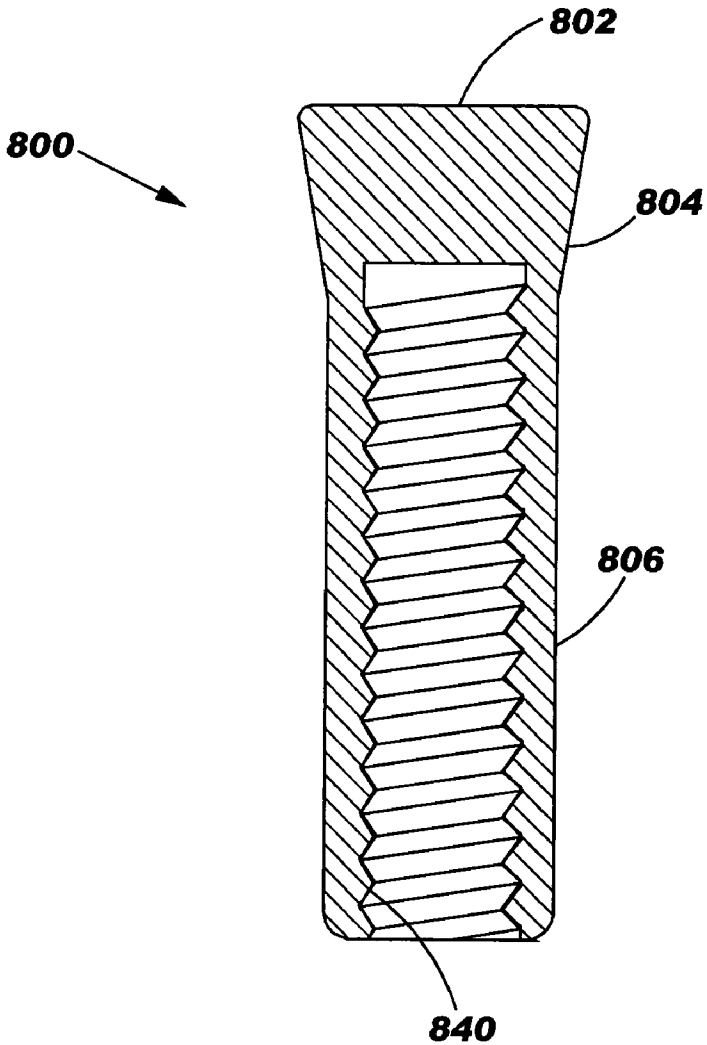
FIG. 8 is a perspective, cut away side view of an alternate driven cap according to embodiments of this invention.

FIG. 6 illustrates a cross section of a perspective side view of the tubular body of FIG. 1 with an alternate "H-shaped" sleeve 700 positioned over and/or about the grounding rod 410. The alternate H-shaped sleeve 700 has exterior dimensions to mate with the longitudinal bore 115 of the tubular body 100. As shown in greater detail in the perspective side view of FIG. 7, the H-shaped sleeve 700 includes an elongated shank 706 having an open proximal end with a first interior, longitudinal bore 715 having a cylindrical side wall 710 and closed end 712 and having an opposed distal end with a second interior, longitudinal bore 735 having a cylindrical side wall 736 and closed end 732. The first bore has a first diameter 720 sized to fit an end of a shafted body with a first complimentary diameter (not shown) and the second bore has a second diameter 730 sized to fit an end of a shafted body with a second complimentary diameter. For example, the first diameter 720 may be sized at ⅝ inch which is a common diameter to fit copper grounding rods and the second diameter 730 may be sized at ½ inch which is a common diameter to fit steel grounding rods. Similar to the driver sleeve 200, an external length 740 of the H-shaped sleeve 700 is equal to or greater than an internal length of the elongated shank 106.

In addition to the above described embodiments, a tubular body 800 similar to the tubular body 100 of FIG. 1 may further include a threaded surface 840 along the exterior surface of a longitudinal bore. The threaded surface could mate with a complimentary exterior surface of a driver sleeve (not shown) or with a complimentary exterior surface of a shafted body (not shown).

Many modifications and other embodiments of the invention will come to mind to one skilled in the art to which this invention pertains having the benefit of the teachings presented in the foregoing descriptions and the associated drawings. For example, the sleeve of the driver cap assembly may be of various types known to those in the art. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of:

positioning a driver cap assembly over a proximal end of a shafted body, comprised of:

providing a driver cap assembly comprised of:

a body having a closed proximal end, an elongated shank, and an open distal end, wherein a first portion of the closed proximal end flares outward from a proximal end of the elongated shank towards a second portion of the closed proximal end, and wherein an interior of the elongated shank and the open distal end comprise a longitudinal bore, the longitudinal bore having an interior wall defining a longitudinal axis of the body, a driver sleeve having a first end, a second end, and a longitudinally extending shank from the first end towards the second end, an exterior surface of the longitudinally extending shank having a complimentary shape to mate with an interior surface of the longitudinal bore of the body such that when the exterior surface is mated with the interior surface, the longitudinally extending shank extends to the open distal end of the body, and the second end having a driver sleeve longitudinal bore, an interior of the driver sleeve longitudinal bore adapted to fit about a proximal end of a shafted body, wherein the driver sleeve longitudinal bore of the second end comprises a planar closed end; and applying an impact force to the proximal end of the driver cap assembly such that a distal end of the shafted body is driven into a surface.

2. A driver cap assembly, comprising:

a body having a closed proximal end, an elongated shank, and an open distal end, wherein a first portion of the closed proximal end flares outward from a proximal end of the elongated shank towards a second portion of the closed proximal end, and wherein an interior of the elongated shank and the open distal end comprise a longitudinal bore, the longitudinal bore having an interior wall defining a longitudinal axis of the body; and a driver sleeve having a first end, a second end, and a longitudinally extending shank from the first end towards the second end, an exterior surface of the longitudinally extending shank having a complimentary shape to mate with an interior surface of the longitudinal bore of the body such that when the exterior surface is mated with the interior surface, the longitudinally extending shank extends to the open distal end of the body, and the second end having a driver sleeve longitudinal bore, an interior of the driver sleeve longitudinal bore adapted to fit about a proximal end of a shafted body, the driver sleeve longitudinal bore of the second end having a planar closed end.

3. A driver cap assembly, comprising:

a body having a closed proximal end, an elongated shank, and an open distal end, wherein a first portion of the closed proximal end flares outward from a proximal end of the elongated shank towards a second portion of the closed proximal end, and wherein an interior of the elongated shank and the open distal end comprise a longitudinal bore, the longitudinal bore having an interior wall defining a longitudinal axis of the body; and a driver sleeve having a first end, a second end, and a longitudinally extending shank from the first end towards the second end, an exterior surface of the longitudinally extending shank having a complimentary shape to mate with an interior surface of the longitudinal bore of the body such that when the exterior surface is mated with the interior surface, the longitudinally extending shank extends to the open distal end of the body, and the second end having a driver sleeve longitudinal bore, an interior of the driver sleeve longitudinal bore adapted to fit about a proximal end of a shafted body, the first end of the driver sleeve having another driver sleeve longitudinal bore adapted to fit about another proximal end of another shafted body, the another driver sleeve longitudinal bore of the first end having a different shape than the driver sleeve longitudinal bore of the second end.

* * * * *